US011347248B2

(12) United States Patent
Matyscak

(10) Patent No.: US 11,347,248 B2
(45) Date of Patent: May 31, 2022

(54) VOLTAGE REGULATOR HAVING CIRCUITRY RESPONSIVE TO LOAD TRANSIENTS

(71) Applicant: SEMICONDUCTOR COMPONENTS INDUSTRIES, LLC, Phoenix, AZ (US)

(72) Inventor: Jiri Matyscak, Roznov Pod Radhostem (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 17/248,814

(22) Filed: Feb. 9, 2021

(65) Prior Publication Data

US 2022/0011798 A1 Jan. 13, 2022

Related U.S. Application Data

(60) Provisional application No. 62/705,692, filed on Jul. 10, 2020.

(51) Int. Cl.

| | |
|---|---|
| ***G05F 1/56*** | (2006.01) |
| ***G05F 1/565*** | (2006.01) |
| ***G05F 1/46*** | (2006.01) |
| ***G05F 1/445*** | (2006.01) |

(52) U.S. Cl.

CPC ..... *G05F 1/565* (2013.01); *G05F 1/445* (2013.01); *G05F 1/461* (2013.01); *G05F 1/468* (2013.01)

(58) Field of Classification Search

CPC ..... G05F 1/565; G05F 1/445; G05F 1/461; G05F 1/468

See application file for complete search history.

(56) References Cited

U.S. PATENT DOCUMENTS

| | | | | |
|---|---|---|---|---|
| 2008/0180080 | A1 | 7/2008 | Terry et al. | |
| 2010/0156362 | A1 | 6/2010 | Xie | |
| 2012/0013317 | A1* | 1/2012 | Morino | G05F 1/565 323/280 |
| 2013/0069607 | A1* | 3/2013 | Suzuki | G05F 1/575 323/271 |
| 2014/0217999 | A1* | 8/2014 | Wibben | H02M 3/156 323/282 |

(Continued)

*Primary Examiner* — Kyle J Moody
*Assistant Examiner* — Lakaisha Jackson
(74) *Attorney, Agent, or Firm* — Brake Hughes Bellermann LLP

(57) ABSTRACT

A load coupled to a linear voltage regulator may create a load transient so that an output of the voltage regulator is temporarily raised to an elevated level above a regulated level. Without compensation, the linear voltage regulator may respond by turning a pass transistor completely OFF thereby losing regulation and allowing a compensation capacitor to become charged in a polarization opposite to one required for regulation. If a subsequent load transient (i.e., back-to-back load transient) is generated while the linear voltage regulator is in this condition, a large spike in the output may occur as the voltage regulator recharges the pass transistor turns back ON and as the compensation capacitor recharges. Disclosed herein is a linear voltage regulator with transient compensation circuitry to prevent the scenario described above and reduce the spike in the output.

20 Claims, 5 Drawing Sheets

(56) References Cited

U.S. PATENT DOCUMENTS

| | | | | |
|---|---|---|---|---|
| 2014/0375289 | A1* | 12/2014 | Kronmueller | G05F 1/565<br>323/280 |
| 2016/0299518 | A1* | 10/2016 | Iwata | G05F 1/468 |
| 2021/0303014 | A1* | 9/2021 | Migliavacca | G05F 1/575 |

* cited by examiner

VOLTAGE REGULATOR HAVING CIRCUITRY RESPONSIVE TO LOAD TRANSIENTS

CROSS-REFERENCE TO RELATED APPLICATION

This application claims the benefit of U.S. Provisional Application No. 62/705,692, entitled "Linear Voltage Regulator with Improved Back-to-Back Load Transient Response, filed on Jul. 10, 2020, which is hereby incorporated by reference in its entirety.

FIELD OF THE DISCLOSURE

The present disclosure relates to voltage regulators and more specifically to a dual-rail linear voltage regulator having circuitry to improve a back-to-back transient response.

BACKGROUND

A linear voltage regulator circuit is configured to convert a fluctuating input voltage at an input to an output voltage at an output that is essentially fixed. The linear voltage regulator may control a voltage drop over a pass-device (i.e., pass-transistor) between an input and an output in order to compensate for changes in the input voltage. For example, as the input voltage increases the controllable voltage drop can increase so that the output voltage remains fixed (i.e., regulated).

A dual-rail linear regulator is a linear voltage regulator that has a bias input so that control circuitry can be powered from a bias voltage applied to the bias input. In other words, the dual-rail linear regulator has two supplies (i.e., rails). In a mobile device, a first rail (i.e., main supply) is an input voltage ($V_{IN}$), which can be received from a converter (i.e., DC/DC converter), while the second rail (i.e., auxiliary supply) is a bias voltage ($V_{BIAS}$), which can be received from a battery. The dual rails can allow an input to output voltage difference (i.e., dropout) to be very low. Accordingly, the dual-rail linear voltage regulator may be referred to as a low-dropout (LDO) regulator or simply as an LDO.

SUMMARY

In at least one aspect, the present disclosure generally describes a voltage regulator. The voltage regulator includes a pass transistor that is configured to generate a voltage drop between an input and an output of the voltage regulator based on a signal at a controlling terminal. The voltage regulator also includes a differential amplifier that is configured to output a signal to the controlling terminal of the pass transistor. The voltage regulator further includes a transient compensation circuit that is configured to adjust an offset of the differential amplifier based on the signal at the controlling terminal of the pass transistor in response to a load transient. For example, the offset may be adjusted to prevent the pass transistor from being turned fully OFF. Additionally, the offset may be adjusted to prevent a compensation capacitor of the differential amplifier from being fully discharged or from being charge in an opposite polarity (i.e., opposite to a polarity while the pass transistor is ON).

In another aspect, the present disclosure generally describes a method for responding to back-to-back transients in a voltage regulator. The method includes sensing a voltage of a gate terminal of a pass transistor of the voltage regulator. When it is determined that a first load transient has created an elevated output voltage at an output of the voltage regulator, the method includes adjusting an offset of an output of a differential amplifier. The differential amplifier is coupled to the gate terminal of the pass transistor so that the adjusted offset output prevents a difference between the elevated output voltage and a reference level from grounding the gate terminal of the pass transistor. Preventing the grounding of the gate terminal can prevent the pass transistor from turning OFF completely in response to the first load transient so that the voltage regulator can respond more quickly to a second load transient when the second load transient and the first load transient are back-to-back load transients. For example, preventing the pass transistor from turning OFF completely can prevent a compensation capacitor of the voltage regulator from being charged in a polarity opposite to a polarity required for regulation, which can improve a response time of the regulation so that a voltage spike caused by the second load transient is reduced.

In another aspect, the present disclosure generally describes a system. The system includes a load that is capable of (e.g., configured to) generate a load transient. The system further includes a dual-rail linear voltage regulator that is configured to supply an output voltage and an output current to the load at an output. The dual-rail linear voltage regulator includes a pass transistor that is configured to generate a voltage drop between an input and the output based on an error signal at a controlling terminal. The dual rail linear voltage regulator further includes a differential amplifier that is configured to generate the error signal based on a difference between the output voltage and a reference level. When a load transient causes a temporary change in the output voltage, a transient compensation circuit of the dual-rail linear voltage regulator is configured to adjust an offset of the error signal to an adjusted value. The adjusted value can prevent the temporary change in the output voltage from turning the pass transistor completely OFF. When the temporary change in the output voltage recovers to a regulated level, the compensation circuit is configured to return the offset of the error signal to a normal value (e.g., zero).

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily to scale relative to each other. Like reference numerals designate corresponding parts throughout the several views.

DETAILED DESCRIPTION

A dual-rail linear voltage regulator (i.e., regulator) can supply a load with a changing current/voltage. A change in the load current/voltage (i.e., a load transient) can create a transient response that includes a temporary change (e.g., undershoot, overshoot) in an output voltage ($V_{OUT}$) as the regulator recovers from the load transient. If a second load transient occurs while the regulator is recovering from a first load transient, a voltage undershoot (i.e. spike) corresponding to the transient response from the second load transient may be too large for some systems. Accordingly, the dual-rail linear regulator may have a back-to-back transient response requirement that limits an amplitude of spikes resulting from back-to-back load transients. Disclosed herein is a dual-rail linear voltage regulator having circuitry to improve a back-to-back transient response.

Figure 1:
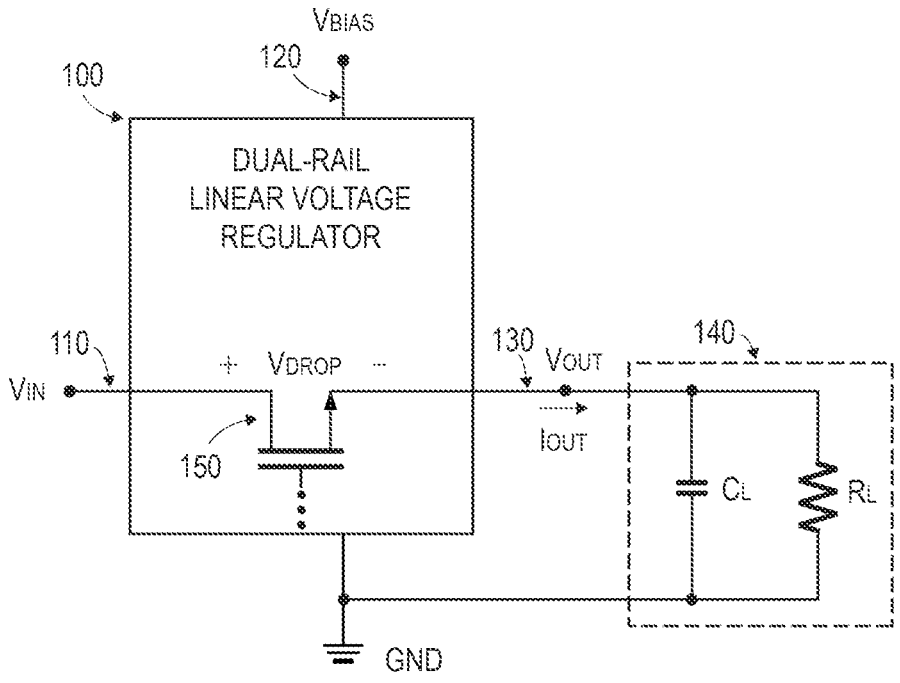
FIG. 1 is a block diagram of a dual-rail linear voltage regulator coupled to a load according to an implementation of the present disclosure.

FIG. 1 is a block diagram of a dual-rail linear voltage regulator configured to receive an input voltage ($V_{IN}$) at an input terminal 110 (i.e., input) and a bias voltage ($V_{BIAS}$) at a bias terminal 120. The regulator 100 is configured to output an output voltage ($V_{OUT}$) (i.e., regulated voltage) at an output terminal 130 (i.e., output). The output terminal may be coupled to a load 140. In a possible implementation, the load can be expressed as an equivalent load capacitance ($C_L$) (i.e., output capacitance) and load resistance ($R_L$) (i.e., output resistance), as shown in FIG. 1.

The load 140 may draw an output current ($I_{OUT}$) from the regulator 100. The output current drawn by the load 140 may change over time as the load resistance ($R_L$) and/or the load capacitance ($C_L$) change due to an operation of the load. For example, the load 140 can be a processor that draws more output current or less output current as processing demands change. When the load is in a high load (i.e., heavy load) condition, the output current ($I_{OUT}$) can be at a level that is higher than when the load is in a low load (i.e., light load) condition. A change from a light load to a heavy load can cause a load transient response (i.e., transient response) in the regulator 100.

The regulator 100 can include a control loop configured to compare the output voltage ($V_{OUT}$) to a reference voltage ($V_{REF}$) (i.e., reference level). The comparison can result in an error signal that can be used to drive a pass transistor 150, which is coupled between the input and the output. A change in the error signal can change a conduction of the pass transistor 150. In regulation, the pass transistor 150 is in an ON condition. The ON condition of the pass transistor may include a range of operating conditions. For example, the pass transistor 150 may be configured to pass a lower current when partially ON than when fully ON and may have a higher voltage drop ($V_{DROP}$) when partially ON than when fully ON. When the pass transistor 150 is in an OFF condition (i.e., not conducting, fully OFF), the regulator is said to be out of regulation because the relationship between the input voltage and the output voltage is uncontrolled by the control loop.

A pass transistor for a dual-rail linear voltage regulator can be an N-type metal oxide semiconductor (i.e., NMOS) transistor. In regulation, a drop in the output voltage ($V_{OUT}$) (e.g., below the reference level) can increase the error signal to reduce the voltage drop ($V_{DROP}$) across the pass transistor 150. Conversely, an increase in the output voltage ($V_{OUT}$) (e.g., above the reference level) can reduce the error signal to increase the voltage drop across ($V_{DROP}$) across the pass transistor. The control loop may iteratively increase/decrease the error signal until the voltage drop makes the output voltage equal to the reference level. The control loop has a finite range. For example, the error signal can be reduced until the pass transistor is turned fully OFF. If, at this point, the output voltage is still above the reference level, the control loop is saturated in this OFF condition until the output voltage recovers on its own. In other words, while the control loop is saturated, regulation is lost.

The regulator can include, for stability, a compensation capacitor (i.e., compensation capacitance) in the error signal circuitry (not shown) driving the pass transistor 150. This compensation capacitance can affect a response of the regulator to the changes in the output voltage. In particular, the compensation capacitance can affect (e.g., increase) a time required for the regulator to recover from a change in the load (i.e., load transient).

Figure 2:
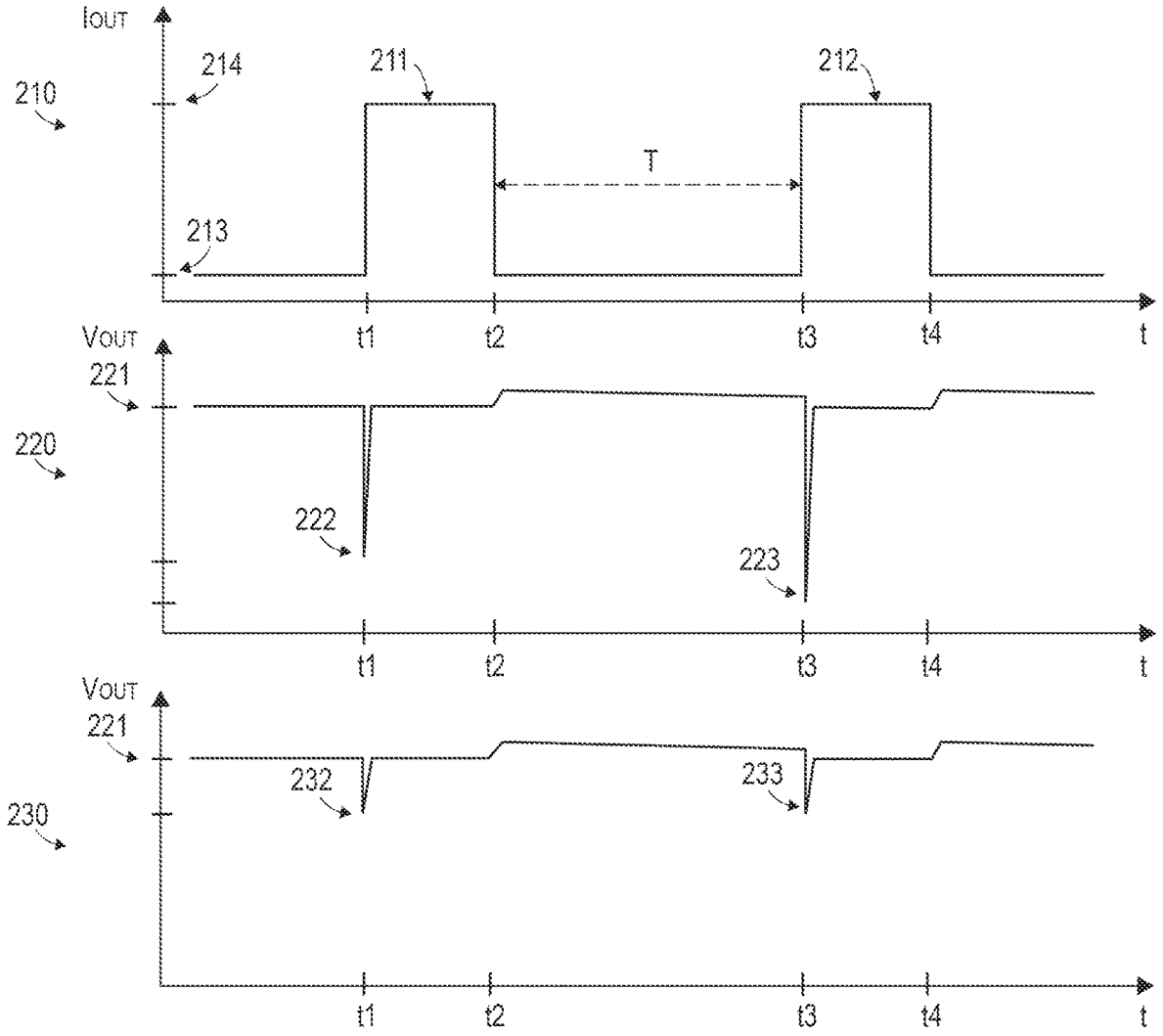
FIG. 2 includes graphs illustrating possible back-to-back transient responses of the regulator of FIG. 1 to a changing output current.

FIG. 2 includes graphs illustrating possible back-to-back transient responses of the regulator of FIG. 1. A first graph 210, illustrates the output current ($I_{OUT}$) of the regulator 100. In a first transient 211, the output current ($I_{OUT}$) changes from a low level 213 (e.g., 1 microamp (μA)) to a high level 214 (e.g., 700 milliamps (mA)) at a first time (t1) then returns to the low level 213 at a second time (t2). A second transient 212 occurs a period (T) after the first transient 211. In the second transient 212, the output current ($I_{OUT}$) changes from the low level 213 to the high level 214 at a third time (t3) and then returns to the low level 213 at a fourth time (t4). The period (T) is shorter than a time required for the regulator to recover from the first transient 211. Accordingly, the first transient 211 and the second transient 212 are referred to as back-to-back transients.

A second graph 220 illustrates the output voltage ($V_{OUT}$) response of the regulator 100 to the transients of the first graph 210 when the regulator 100 does not compensate for the load transients. At the first time (t1), the output current rises from the low level 213 to the high level 214 and the voltage drops below a regulated level 221. In this condition, the compensation capacitance is quickly discharged into the load, but at the same time, the control loop increases the conductivity of the pass transistor. As a result, the compensation capacitance is quickly recharged (i.e., to a first polarity) by the increased output current and the output voltage recovers to the regulated level 221. In summary, as the current demand of the load increases, the regulator is configured to source current and the compensation capacitance is charged to a first (i.e., positive) polarity.

At the second time (t2), the output current drops from the high level 214 to the low level 213 and the voltage rises above a regulated level 221. In this condition, the load (i.e., load capacitance ($C_L$)) is charged to the elevated voltage. The control loop reduces the ON condition of the pass transistor in an attempt to lower the output voltage. The pass transistor is turned OFF completely as the control loop saturates in an attempt to make the voltage drop across the pass transistor large to reduce the increase. For example, the pass transistor may be turned OFF completely (i.e., fully turned OFF) when a gate-source voltage of the pass transistor is reduced below a threshold voltage of the pass transistor. When the control loop is saturated, control is lost and cannot be regained until the load capacitance ($C_L$) is discharged, but the discharge occurs slowly because the load current is small and because the regulator cannot sink current from the load as well (i.e., as fast) as it can source current to the load. Additionally, the compensation capacitance is charged into a reverse polarity. In summary, as the current demand of the load decreases, the regulator is configured to sink current and the compensation capacitance is charged to a second (i.e., negative) polarity.

At the third time (t3), the output current increases, discharging the charged compensation capacitance (i.e., the compensation capacitance charged to the second (negative) polarity). When the output current increases, the output voltage decreases but the control loop cannot respond until the discharged compensation capacitance is, once again, charged to the first (i.e., positive) polarity. In this time for the control loop to respond, the output voltage can undershoot by a large amount before it is brought back to the regulated level 221. The time necessary to discharge and recharge the compensation capacitance is longer than a time necessary to discharge the compensation capacitance. Accordingly, the second undershoot 223 in the back-to-back transients can have a larger amplitude than a first undershoot 222. Some systems cannot tolerate the increased amplitude of the second undershoot 223.

A third graph 230 illustrates the output voltage ($V_{OUT}$) response of the regulator 100 to the transients of the first graph 210 when the regulator 100 compensates for back-to-back transients. As shown, the amplitudes of a first compensated undershoot 232 and a second compensated undershoot 233 in the third graph 230 are smaller than the amplitudes of the first undershoot 222 and the second undershoot 223 in the second graph 220. Additionally, the amplitudes of the undershoots in the third graph 230 are more consistent (e.g., are equal) than the amplitudes of the undershoots in the second graph 220. The reason for the responses shown in the third graph 230 will be described in more detail later, but as shown, a benefit of the disclosed circuits and methods is improving a response to load transients by reducing the amplitudes of the undershoots in back-to-back transients.

Figure 3:
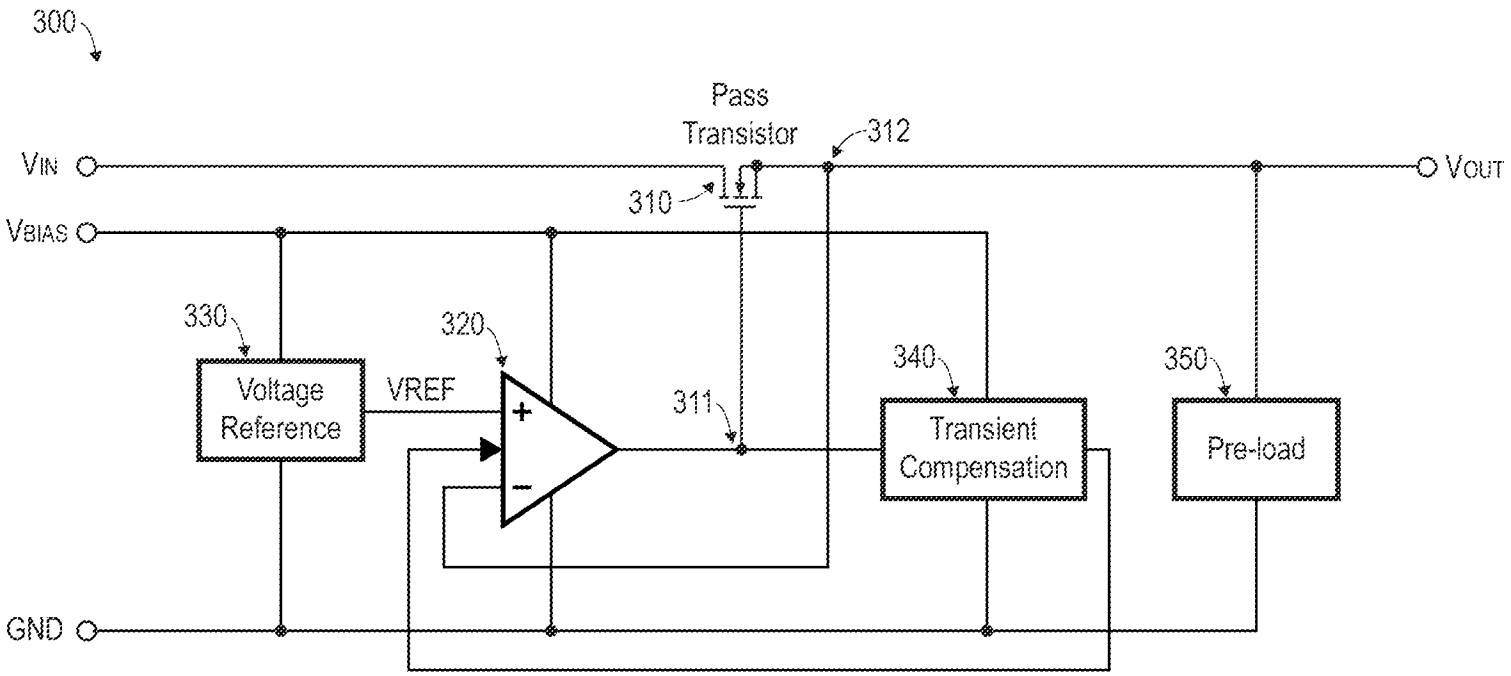
FIG. 3 is a block diagram of a dual-rail linear voltage regulator including circuitry responsive to load transients according to an implementation of the present disclosure.

FIG. 3 is a block diagram of a dual-rail linear voltage regulator including circuitry responsive to load transients (i.e. including transient compensation circuitry) according to an implementation of the present disclosure. As described, the regulator 300 includes a pass transistor 310 with a conductivity (i.e., voltage drop) controlled by an error signal applied to a gate terminal 311 of the pass transistor. The error signal is generated by an error amplifier 320 configured to compare the output voltage ($V_{OUT}$) at source terminal 312 of the pass transistor 310 to a reference voltage ($V_{REF}$) generated by a voltage reference 330. The voltage reference 330 and the error amplifier 320 are powered by the bias voltage ($V_{BIAS}$). In a back-to-back transient scenario, the error amplifier 320 can saturate and temporarily lose control of the output by turning the pass transistor 310 fully OFF (e.g., grounding the gate terminal 311).

To compensate for back-to-back transients, the regulator 300, shown in FIG. 3, includes a transient compensation circuit 340 (i.e., regulation detector). The transient compensation circuit 340 is configured to sense the error signal at the gate terminal 311 of the pass transistor 310 and adjust the error amplifier 320 to prevent the error amplifier from saturating. For example, the transient compensation circuit 340 can be configured to control an offset of the error amplifier 320 when the output voltage rises above a threshold so that the pass transistor 310 is not turned fully OFF. This can also prevent the compensation capacitance from becoming charged in the reverse (i.e., negative) polarity. For example, when the output voltage ($V_{OUT}$) rises above the regulated level, the offset can cause the pass transistor 310 to be held at the edge of regulation. For example, the pass transistor 310 may be held at the edge of regulation by holding a gate-source voltage of the pass transistor 310 slightly above the threshold voltage of the pass transistor (i.e., the pass transistor is nearly OFF but not completely OFF). As result, a first transient does not cause the regulator 300 to lose control and therefore the regulator 300 is ready to respond to a second (i.e., back-to-back transient). Additionally, the compensation capacitor does not require a full recharge. Accordingly, the regulator 300 can quickly respond to the second transient, thereby limiting an amplitude of the second undershoot 223 to an acceptable level. The transient compensation circuit 340 can keep the amplifier in regulation and the pass transistor on the edge of regulation until the load recovers from the transient and may not affect the regulation otherwise.

The regulator further includes a pre-load 350 coupled between the pass transistor 310 and a ground (GND). The pre-load 350 is configured to drain residual current from the pass transistor 310 when the pass transistor is controlled at the edge of regulation (i.e., in a nearly OFF state, high impedance state). In this state, the pass transistor 310 may have a high, but finite, resistance. Accordingly, a small (e.g., 10 microamps (μA)) current conducted by the pass transistor in this state can be drained to ground by the pre-load 350. A resistance of the pre-load 350 may be made high to prevent the pre-load from significantly affecting the output and to minimize a resulting quiescent current of the regulator 300.

Figure 4:
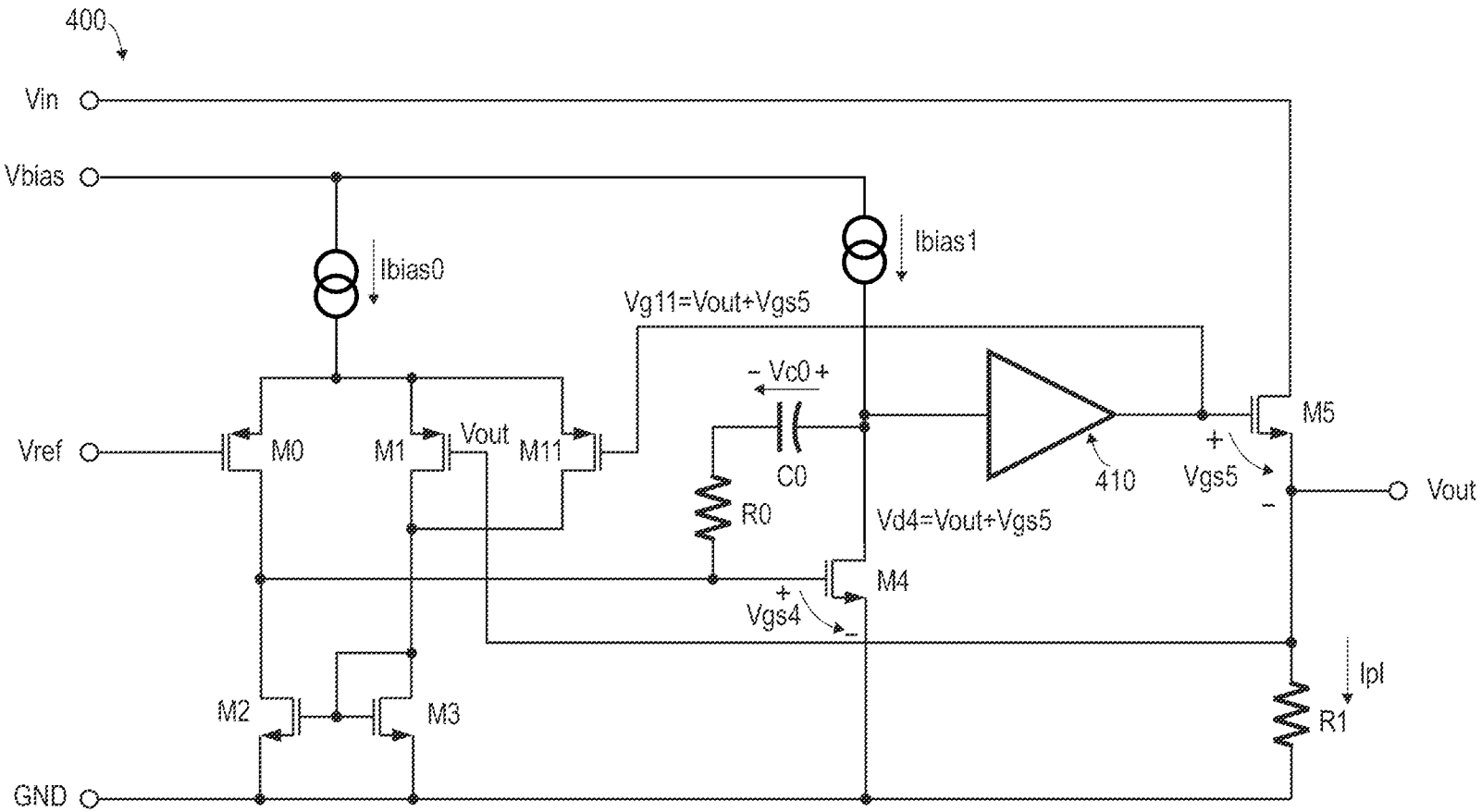
FIG. 4 is a schematic of a dual-rail linear voltage regulator including circuitry responsive to load transients according to an implementation of the present disclosure.

FIG. 4 is a schematic of a dual-rail linear voltage regulator (i.e., regulator) including circuitry responsive to load transients (i.e., a transient compensation circuit) according to an implementation of the present disclosure. The regulator 400 includes a pass transistor (M5) (i.e., output transistor) coupled at a drain to an input of the regulator, at a source to an output of the regulator, and at a gate to an output of an error amplifier. The error amplifier of the regulator can have three stages. In some implementation the error amplifier may include a current limiter after the final stage of the error amplifier, but this is not required.

A first stage of the error amplifier includes a first bias current source (I0), a differential pair of transistors (M0, M1) and a current mirror (M2, M3) that are configured as a differential amplifier. The differential pair of transistors (M0, M1) are matched in a size (A). A first transistor (M0) of the differential pair is configured to receive a reference voltage (e.g., 1.5V) at its gate terminal, while a second transistor (M1) of the differential pair is configured to receive the output voltage ($V_{OUT}$) at its gate terminal. When the output voltage ($V_{OUT}$) matches the reference voltage ($V_{REF}$) (i.e., regulation), the first bias current (Ibias0) can be divided equally between the first transistor (M0) and the second transistor (M1) due to their matching size and gate voltages in the regulated condition.

A second stage of the error amplifier includes a transistor (M4) coupled at a drain terminal to a second bias current source (I1) and coupled at a source terminal to ground. The transistor (M4) operates as an amplifier that is configured to receive an output voltage from the first stage at its gate terminal. The second stage further includes a frequency compensation circuit for stability. The frequency compensation circuit is coupled between the gate terminal of the transistor (M4) and the drain terminal of the transistor (M4). The frequency compensation circuit can include a series connection of a compensation resistor (R0) and a compensation capacitor (C0). The compensation capacitor is coupled to a third stage of the error amplifier, which includes a unity-gain amplifier (i.e., buffer 410). The unity gain amplifier is configured to buffer an output of the second stage to a gate terminal of the pass transistor (M5).

The compensation capacitor (C0) of the second stage is configured to provide a delay between changes in the output voltage ($V_{OUT}$) and adjustments made to the pass transistor (M5). This delay can prevent the circuit from becoming unstable (e.g., oscillating), but as described previously can allow for voltage spikes (e.g., undershoots) to occur before the regulator can respond to a load transient. This is especially true for back-to-back transients.

After a first load transient, the output voltage ($V_{OUT}$) can be maintained at a higher level than the reference voltage ($V_{REF}$) by a load capacitor (i.e., output capacitor) that is charged. In this condition, the error amplifier can become saturated in an OFF state, making the regulator lose regulation. When a second (i.e., back-to-back) load transient occurs and raises the load current. The high load current quickly discharges the load capacitor and the output voltage ($V_{OUT}$) is reduced, thereby crossing the reference voltage level ($V_{REF}$). The first stage of the error amplifier responds to the crossing of the reference level, but the response is delayed while the compensation capacitor is recharged back to its normal operating voltage. As a result, the output voltage ($V_{OUT}$) can undershoot by an amount that corresponds to this delay. The present disclosure includes transient compensation circuitry (e.g., M11) (i.e., regulation detector) to change the way the error amplifier (e.g., the first stage) responds to transient conditions to prevent the compensation capacitor from being fully discharged by transients, and thereby reduce a recharge delay during which the output voltage can undershoot.

A bypass transistor (M11) is included in the regulator 400 to prevent the error amplifier from becoming saturated and configuring the pass transistor in a fully OFF state. The bypass transistor (M11) is coupled to the differential pair of transistors (M0, M1) and is a size (B) that is different from a size (A) of each transistor in the differential pair of transistors. In a possible implementation, the bypass transistor (M11) is smaller than the transistors of the differential pair (M0, M1).

The bypass transistor (M11) is coupled at its gate terminal to the gate terminal of the pass transistor (M5). In other words, the transient compensation circuitry is configured to sense a gate terminal of the pass transistor (M5). The bypass transistor (M11) can be a PMOS transistor. When the output voltage ($V_{OUT}$) is increased above the reference level ($V_{REF}$), a gate voltage of the pass transistor is reduced and the bypass transistor (M11) is turned ON (i.e., made to conduct). When ON, the bypass transistor (M11) conducts some of the bias current (Ibias0) from the first bias current source (I0). This conduction can offset the output of the differential amplifier to prevent the second stage (M4) from becoming saturated in the ON condition, which can charge the compensation capacitor in the reverse polarity. The precise operating point of the second stage (M4) for a given output voltage ($V_{OUT}$) is determined by a size ratio (A/B) of the transistors (M0, M1) of the differential pair to the bypass transistor (M11). A suitable value for the size ratio may be determined empirically based on load conditions and circuit parameters (e.g., M4, M5 dimensions). For example, the size ratio may be determined to be between 10 and 20 (i.e., $10 \leq A/B \leq 20$).

Operation of the regulator 400 in a normal regulation condition is as follows. In regulation, an output voltage equals a reference voltage (e.g., $V_{OUT}=V_{REF}=1.5V$). In this condition, the second stage transistor (M4) is driven in an active region (e.g., Vgs4=0.4V) and the pass transistor (M5) (i.e., output transistor) is ON and driven according to an output current demand (e.g., Vgs5=0.9V). In regulation, the bypass transistor (M11) is OFF because its gate voltage is made relatively high (e.g., Vg11=2.4V) by the gate voltage of the conducting pass transistor. Accordingly, in normal operation (i.e., non-transient conditions), the bypass transistor (M11) does not influence the operation of the differential pair of transistors (M0, M1). In a regulation (e.g., $V_{OUT}=V_{REF}=1.5V$), a drain voltage (e.g., Vd4=2.4V) at the second stage transistor (M4) charges the compensation capacitor (C0) to a positive polarity (e.g., Vc0=2.0V).

Without the bypass transistor (M11), when a transient condition (e.g., $V_{OUT}=1.505V$) occurs, most of the bias current (Ibias0) is conducted by the first transistor (M0) of the differential pair (M0, M1). The unbalanced differential pair can drive the second stage transistor (M4) ON completely (e.g., Vgs4≈2.2V). when the second stage transistor is ON a gate of the pass transistor (M5) is grounded (e.g., Vgs5=−1.505V) and the pass transistor is turned OFF completely. The grounded node (i.e., gate terminal of the pass transistor) also allows the compensation capacitor (C0) to be charged to a reverse (i.e., negative) polarity (e.g., Vc0=−Vgs4≈−2.2V). The bypass transistor (M11) helps to avoid grounding the gate terminal of the pass transistor (i.e., turning the pass transistor fully OFF) so that the compensation capacitor is not charged in a reverse polarity.

With the bypass transistor (M11), when the transient condition (e.g., $V_{OUT}=1.505V$) occurs, the pass transistor (M5) begins to turn OFF (i.e., Vgs5=0.015V). As a result, the gate voltage of the bypass transistor is reduced (e.g., Vg11=1.52V), thereby turning the bypass transistor ON so that it conducts a portion of the bias current (Ibias0). The portion of the bias current conducted by the bypass transistor is determined by the size ratio (A/B) and can be set to rebalance the differential pair (M0, M1). The balancing of the currents can reduce a gate voltage (e.g., Vgs4=0.41V) at the second stage (M4) to prevent the second stage transistor (M4) from turning completely ON (i.e., saturating). As a result, the compensation capacitor remains charged to a reduced, but still positive polarity voltage (e.g., Vc0=1.11V), and the output capacitor M5 is held in an ON condition that is slightly above the completely OFF (i.e., non-conducting) condition (i.e., at the edge of regulation). Because the output capacitor (M5) is slightly conducting, a pre-load resistor (R1) can be used to drain a small pre-load current (e.g., Ip1=10 μA) to ground.

By maintaining the compensation capacitor (C0) at a voltage (e.g., Vc0=1.11V) that is close to its normal operating voltage during regulation (e.g., Vc0=2.0V) a subsequent load transient does not require a complete re-charge of the capacitor. Accordingly, the regulator can respond to an undershoot more quickly, thereby limiting an amplitude of the undershoot. The approach senses a gate terminal of the pass transistor and based on the sensing, can adjust an offset of a differential amplifier to maintain conduction of the pass transistor and prevent a compensation capacitor from being completely discharged and charged into a negative polarity.

The offset of the differential amplifier may be decided by the size of the M0 and M1 transistors, which each have a size, A, versus a size, B, of the M11 transistor, where size A is greater than size B. The A/B ratio may be any of a range (e.g., $1<A/B<50$) of values depending on the implementation and the specification of the linear voltage regulator. According to one implementation, the ratio is 20. The size of the M11 transistor may be effectively adjusted by adding transistors (not shown) in parallel with M11.

Figure 5:
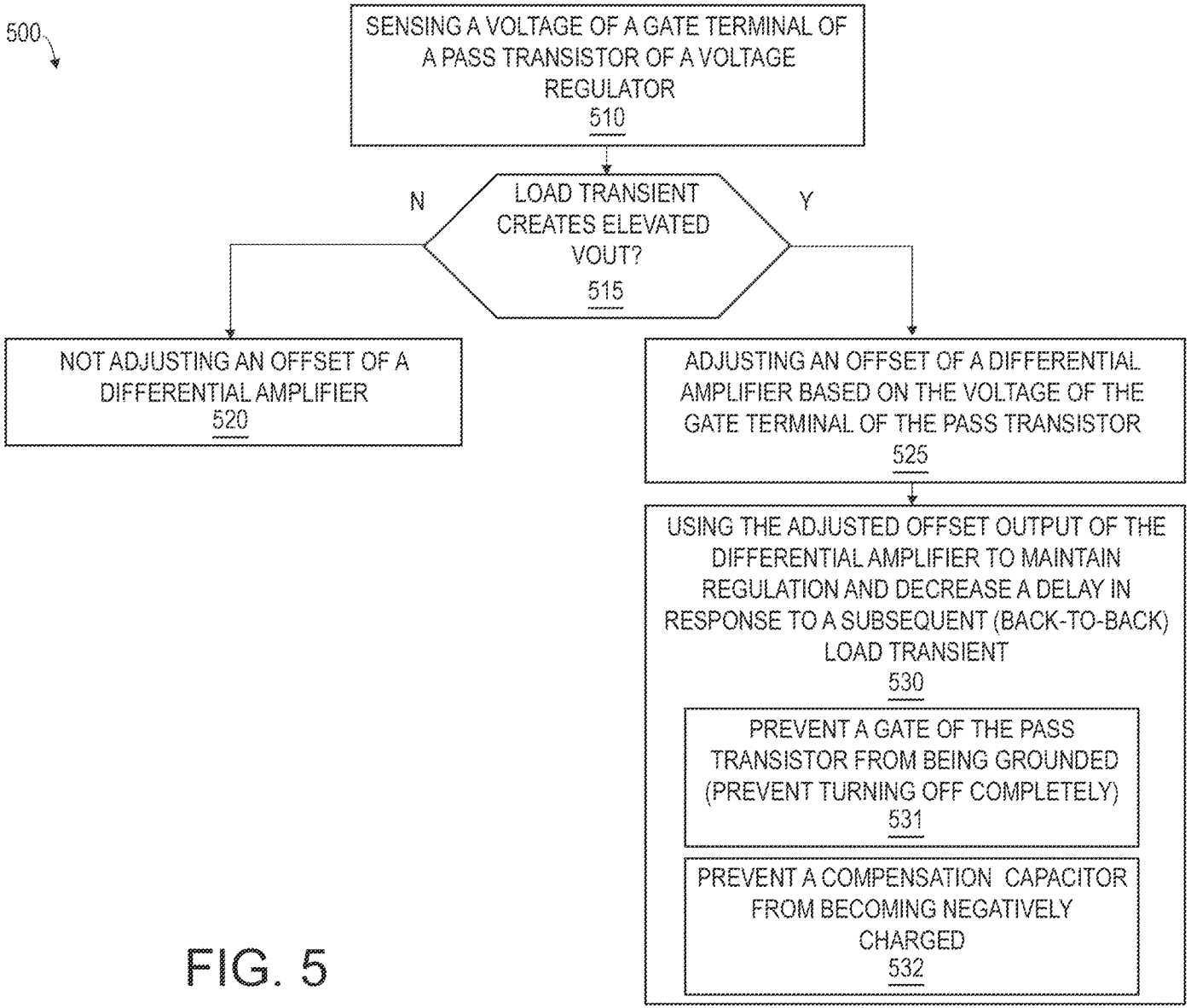
FIG. 5 is a flowchart of a method for responding to back-to-back load transients in a voltage regulator according to an implementation of the present disclosure.

FIG. 5 is a flowchart of a method for responding to back-to-back transients in a voltage regulator according to an implementation of the present disclosure. The method 500 includes sensing 510 a voltage of a gate terminal of a pass transistor of the voltage regulator. The method further includes determining 515 if a load transient creates an elevated output voltage ($V_{OUT}$). When a load transient creates the elevated output voltage, the method includes adjusting 525 an offset of a differential amplifier based on the voltage of the gate terminal of the pass transistor and using 530 the adjusted offset output of the differential amplifier to maintain regulation and decrease a delay in a response to a subsequent (i.e., back-to-back) load transient. This delay in the response can be decreased by preventing 531 the pass transistor from turning OFF completely by preventing a gate of the pass transistor from being grounded. Further the delay in the response can be decreased by preventing 532 a compensation capacitor from being charged into an opposite polarity. For example, preventing the pass transistor from turning OFF completely can prevent a compensation capacitor of the voltage regulator from being charged in a polarity opposite to a polarity required for regulation (i.e., prevent the compensation capacitor from being negatively charged). When the output voltage is not elevated by a transient, however, the differential amplifier of the voltage regulator is not adjusted 520. For example, an output of the differential amplifier may have a first offset in a non-transient condition and a second offset in a transient condition. The first offset can be zero and the second offset can be set by a size of a bypass transistor of a transient compensation circuit of the differential amplifier.

In the specification and/or figures, typical embodiments have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

It will be understood that, in the foregoing description, when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application, if any, may be amended to recite exemplary relationships described in the specification or shown in the figures.

As used in this specification, a singular form may, unless definitely indicating a particular case in terms of the context, include a plural form. Spatially relative terms (e.g., over, above, upper, under, beneath, below, lower, and so forth) are intended to encompass different orientations of the device in use or operation in addition to the orientation depicted in the figures. In some implementations, the relative terms above and below can, respectively, include vertically above and vertically below. In some implementations, the term adjacent can include laterally adjacent to or horizontally adjacent to.

The invention claimed is:

1. A voltage regulator, comprising:
   - a pass transistor configured to generate a voltage drop between an input and an output of the voltage regulator based on a signal at a controlling terminal;
   - a differential amplifier configured to output a signal to the controlling terminal of the pass transistor; and
   - a transient compensation circuit configured to adjust an offset of the differential amplifier based on the signal at the controlling terminal of the pass transistor in response to a load transient.

2. The voltage regulator according to claim 1, wherein the offset is adjusted to prevent the pass transistor from being turned fully OFF.

3. The voltage regulator according to claim 1, wherein the differential amplifier includes a compensation capacitor and the offset is adjusted to prevent the compensation capacitor from being fully discharged or from being charged in an opposite polarity.

4. The voltage regulator according to claim 1, wherein the differential amplifier includes a differential pair of transistors receiving a first portion and a second portion of a bias current, the first portion and the second portion being equal when an output voltage is equal to a reference level and the first portion and the second portion being not equal when the output voltage is above the reference level.

5. The voltage regulator according to claim 4, wherein the transient compensation circuit includes a bypass transistor configured to conduct a third portion of the bias current when the output voltage is above the reference level and not conduct when the output voltage equal to the reference level.

6. The voltage regulator according to claim 5, wherein the differential pair of transistors are each a first size and the bypass transistor is a second size smaller than the first size.

7. The voltage regulator according to claim 6, wherein the offset is adjusted by a level of the third portion, which corresponds to a size ratio of the first size to the second size.

8. The voltage regulator according to claim 1, wherein the voltage regulator is a dual-rail linear voltage regulator.

9. The voltage regulator according to claim 8, wherein the pass transistor is a N-type metal oxide semiconductor transistor and the controlling terminal is a gate terminal.

10. The voltage regulator according to claim 1, wherein the offset is adjusted to decrease a delay in a response of the voltage regulator to a load-transient in back-to-back load transients.

11. The voltage regulator according to claim 10, wherein the delay corresponds to a time necessary to re-charge a compensation capacitor.

12. The voltage regulator according to claim 10, wherein a decrease of the delay in the response of the voltage regulator to the load transient corresponds to a reduction of an amplitude of the load transient.

13. The voltage regulator according to claim 12, wherein the load transient is an undershoot of an output voltage of the voltage regulator.

14. The voltage regulator according to claim 1, wherein the differential amplifier includes three stages.

15. The voltage regulator according to claim 14, wherein:

a first stage of the three stages includes a first bias current source, a differential pair of transistors, and a current mirror, a first transistor of the differential pair of transistors receiving a reference voltage from a reference voltage source and a second transistor of the differential pair of transistors receiving an output voltage from the output of the voltage regulator;

a second stage of the three stages includes a second bias current source, a transistor amplifier, and a compensation capacitor that is coupled between a drain of the transistor amplifier and a gate of the transistor amplifier; and a third stage of the three stages includes a unity gain buffer amplifier that is coupled between the drain of the transistor amplifier and the controlling terminal of the pass transistor.

16. The voltage regulator according to claim 15, wherein the first stage, the second stage, and the third stage are powered by a bias voltage at a bias terminal of the voltage regulator.

17. A method for responding to back-to-back load transients in a voltage regulator, the method comprising:

sensing a voltage of a gate terminal of a pass transistor of the voltage regulator;

determining that a first load transient has created an elevated output voltage at an output of the voltage regulator;

adjusting an offset of an output of a differential amplifier coupled to the gate terminal of the pass transistor to prevent a difference between the elevated output voltage and a reference level from grounding the gate terminal of the pass transistor; and preventing the pass transistor from turning OFF completely in response to the first load transient so that the voltage regulator can respond more quickly to a second load transient, the first load transient and the second load transient being back-to-back transients.

18. The method for responding to back-to-back load transients in a voltage regulator according to claim 17, wherein:

preventing the pass transistor from turning OFF completely prevents a compensation capacitor of the voltage regulator from being charged in a polarity opposite to a polarity required for regulation.

19. A system comprising:

a load configured to generate a load transient; and a dual-rail linear voltage regulator configured to supply an output voltage and output current to the load at an output, the dual-rail linear voltage regulator including:

a pass transistor configured to generate a voltage drop between an input and the output based on an error signal at a controlling terminal;

a differential amplifier configured to generate the error signal based on a difference between the output voltage and a reference level, the load transient causing a temporary change in the output voltage; and a transient compensation circuit configured to adjust an offset of the error signal to an adjusted value to prevent the temporary change in the output voltage from turning the pass transistor completely OFF.

20. The system according to claim 19, wherein the transient compensation circuit is further configured to return the offset of the error signal to a normal value when the temporary change in the output voltage recovers to a regulated level.

* * * * *